US005892831A

United States Patent [19]

Schott

[11] Patent Number: 5,892,831

[45] Date of Patent: Apr. 6, 1999

[54] METHOD AND CIRCUIT FOR CREATING AN EXPANDED STEREO IMAGE USING PHASE SHIFTING CIRCUITRY

[75] Inventor: Wayne Milton Schott, Seymour, Tenn.

[73] Assignee: Philips Electronics North America Corp., New York, N.Y.

[21] Appl. No.: 800,636

[22] Filed: Feb. 14, 1997

Related U.S. Application Data

[63] Continuation-in-part of Ser. No. 497,316, Jul. 3, 1995.

[51] Int. Cl.[6] ..... H04K 5/00

[52] U.S. Cl. ..... 381/1; 281/17; 281/97

[58] Field of Search ..... 381/1, 17–23, 381/309–310, 26–28, 63, 97–98, 99

[56] References Cited

U.S. PATENT DOCUMENTS

| | | | |
|---|---|---|---|
| 4,349,698 | 9/1982 | Iwahara | 381/1 |
| 4,356,349 | 10/1982 | Robinson | 381/1 |
| 4,451,927 | 5/1984 | Hersheberger | 381/15 |
| 4,817,162 | 3/1989 | Kihara | 381/17 |
| 4,868,878 | 9/1989 | Kunugi et al. | 381/1 |
| 5,414,774 | 5/1995 | Yumoto | 381/1 |

FOREIGN PATENT DOCUMENTS

| | | | |
|---|---|---|---|
| 412725 | 2/1991 | European Pat. Off. | 381/17 |

*Primary Examiner*—Curtis A. Kuntz
*Assistant Examiner*—Xu Mei
*Attorney, Agent, or Firm*—Michael E. Belk

[57] ABSTRACT

In portable stereo radio receivers and television receivers, the loudspeakers therein may be separated only by a limited amount. This severely restricts the stereo image created by the loudspeakers. A circuit arrangement for creating an expanded stereo image may be incorporated in such receivers. This circuit arrangement first forms a combined monaural signal and a differential signal from the two stereo signals. The differential signal is then subjected to a phase shift. The phase-shifted differential signal is then matrixed with the combined monaural signal to form output stereo signals. When reproduced through stereo loudspeakers, the stereo image appears to be greatly expanded, beyond the limited placement of the loudspeakers.

8 Claims, 5 Drawing Sheets

METHOD AND CIRCUIT FOR CREATING AN EXPANDED STEREO IMAGE USING PHASE SHIFTING CIRCUITRY

CROSS-REFERENCE TO RELATED APPLICATION

This is a continuation-in-part application to Applicant's U.S. patent application Ser. No. 08/497,316, filed Jul. 3, 1995.

BACKGROUND OF THE INVENTION

1. Field of The Invention

The subject invention relates to a signal processing circuit for enhancing a stereo image that corresponds to a stereo audio signal.

1. Description of The Related Art

In conventional stereo systems, the amplifying circuits amplify the left and right channel signals and pass these amplified signals to a left and right channel loudspeakers. This is done in an attempt to simulate the experience of a live performance in which the reproduced sounds emanate from different locations. Since the advent of stereo systems, there has been continual development of systems which more closely simulate this experience of a live performance. For example, in the early to mid 1970's, four-channel stereo systems were developed which included two front left and right channel loudspeakers and two rear left and right channel speakers. These systems attempted to recapture the information contained in signals reflected from the back of a room in which a live performance was being held. More recently, surround sound systems are currently on the market which, in effect, seek to accomplish the same effect.

A drawback of these systems is that there are four or more channels of signals being generated and a person must first purchase the additional loudspeakers and then solve the problem of locating the multiple loudspeakers for the system.

As an alternative to such a system, U.S. Pat. No. 4,748,669 to Klayman discloses a stereo enhancement system which simulates this wide dispersal of sound while only using the two stereo loudspeakers. This system, commonly known as the Sound Retrieval System, uses dynamic equalizers, which boost the signal level of quieter components in the audio spectrum relative to louder components, a spectrum analyzer and a feedback and reverberation control circuit to achieve the desired effect. However, as should be apparent, this system is relatively complex and costly to implement.

SUMMARY OF THE INVENTION

It is an object of the present invention to provide a circuit arrangement for enhancing the imaging of a stereo signal such that it seems much larger than the actual spacing between the stereo loudspeakers.

It is a further object of the invention to provide such a circuit arrangement that is relatively simple and inexpensive to implement.

The above objects are achieved in a circuit arrangement for creating an expanded stereo image in a stereo signal, comprising a first input and a second input for receiving, respectively, a left channel signal and a right channel signal of in input stereo signal; first combining means coupled to the first and second inputs for additively combining the left and right channel signals thereby forming a sum signal; first difference forming means also coupled to the first and second inputs for forming a difference between the left and right channel signals, thereby forming a difference signal; phase shifting means having an input for receiving said difference signal; second difference forming means having a first input for receiving said sum signal and a second input coupled to an output of said phase shifting means, said second difference forming means forming a left channel output signal; and second summing means having a first input for receiving said sum signal and a second input coupled to the output of said phase shifting means, said second summing means forming a right channel output signal.

Applicant has found that in small portable stereo receivers and in television receivers, the spacing between the stereo loudspeakers is limited. When the circuit arrangement of the subject invention is incorporated in such receivers, the stereo image is greatly expanded, much beyond the limited placement of the stereo loudspeakers.

BRIEF DESCRIPTION OF THE DRAWINGS

With the above and additional objects and advantages in mind as will hereinafter appear, the invention will be described with reference to the accompanying drawings, in which.

DESCRIPTION OF THE PREFERRED EMBODIMENTS

Figure 1:
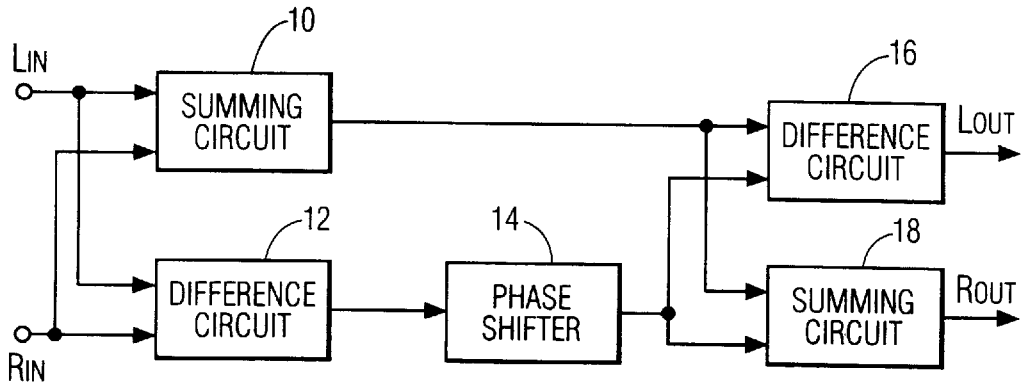
FIG. 1 is a block diagram of a circuit arrangement for a first embodiment of the invention.

FIG. 1 shows a basic block diagram of a circuit arrangement forming a first embodiment of the invention. A left channel input signal is applied to an input $L_{IN}$ of the circuit arrangement and then to a first input of a first summing circuit 10. A right channel input signal is applied to an input $R_{IN}$ of the circuit arrangement and then to a second input of the first summing circuit 10. Similarly, the left and right channel input signals are applied to first and second inputs, respectively, of a first difference circuit 12. An output from the first difference circuit 12 is applied to a phase shifter 14. An output from the first summing circuit 10 is connected to first inputs of a second difference circuit 16 and a second summing circuit 18, respectively, while an output from the phase shifter 14 is connected to second inputs of the second difference circuit 16 and the second summing circuit 18, respectively. The output $L_{OUT}$ of the second difference circuit 16 supplies the left channel output signal, while the output $R_{OUT}$ of the second summing circuit 18 supplies the right channel output signal.

The first summing circuit 10 is used to generate a monaural signal (L+R) and the first difference circuit 12 is used to generate a differential signal (L−R). This is done to prevent amplitude and phase fluctuations in the left and right channel output signals when the circuit arrangement is driven by an (L+R) signal.

The circuit arrangement as shown in FIG. 1 does indeed produce the desired expansion of the stereo image when the gains in the summing and difference circuits are not balanced.

Figure 2:
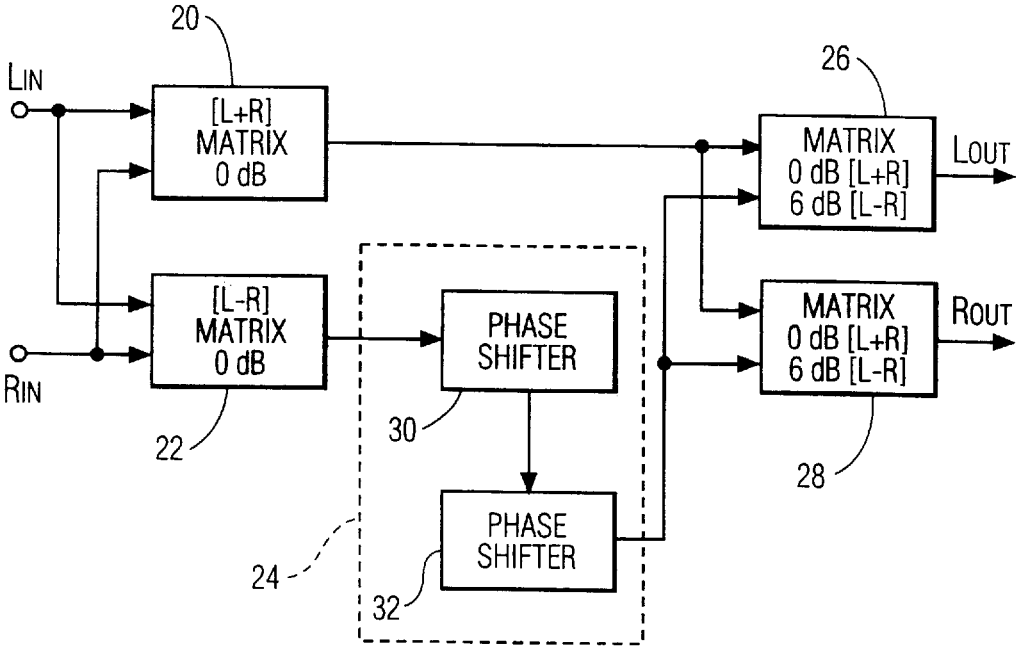
FIG. 2 is a block diagram of a modified circuit arrangement for a second embodiment of the invention.

FIG. 2 shows a basic block diagram of a working embodiment of the invention. In particular, the left channel input signal is applied to an input $L_{IN}$ of the circuit arrangement, while the right channel input signal is applied to an input $R_{IN}$. The input $L_{IN}$ is connected to the first inputs of a first matrix circuit 20 and a second matrix circuit 22, respectively, and the input $R_{IN}$ is connected to the second input of the first and second matrix circuits 20 and 22, respectively. The first matrix circuit 20 forms the sum signal (L+R) and has a gain of 0 dB. The second matrix circuit 22 forms the difference signal (L−R) and has a gain of 14 dB. the output from the second matrix circuit 22 is applied to a phase shifter arrangement 24. The output from the first matrix circuit 20 is applied to the first inputs of a third matrix circuit 26 and a fourth matrix circuit 28, while the output from the phase shifter arrangement 24 is applied to the second inputs of the third and fourth matrix circuits 26 and 28. The third matrix circuit 26, which supplies the left channel output signal to the output $L_{OUT}$ of the circuit arrangement, provides a 0 dB gain for the output from the first matrix circuit 20, and a 6 dB gain for the output from the phase shifter arrangement 24. The fourth matrix circuit 28, which supplies the right channel output signal to the output $R_{OUT}$ of the circuit arrangement, provides a 0 dB gain for the output signal from the first matrix circuit 20, and a 6 dB gain for the output signal from the phase shifter arrangement 24.

Figure 3:
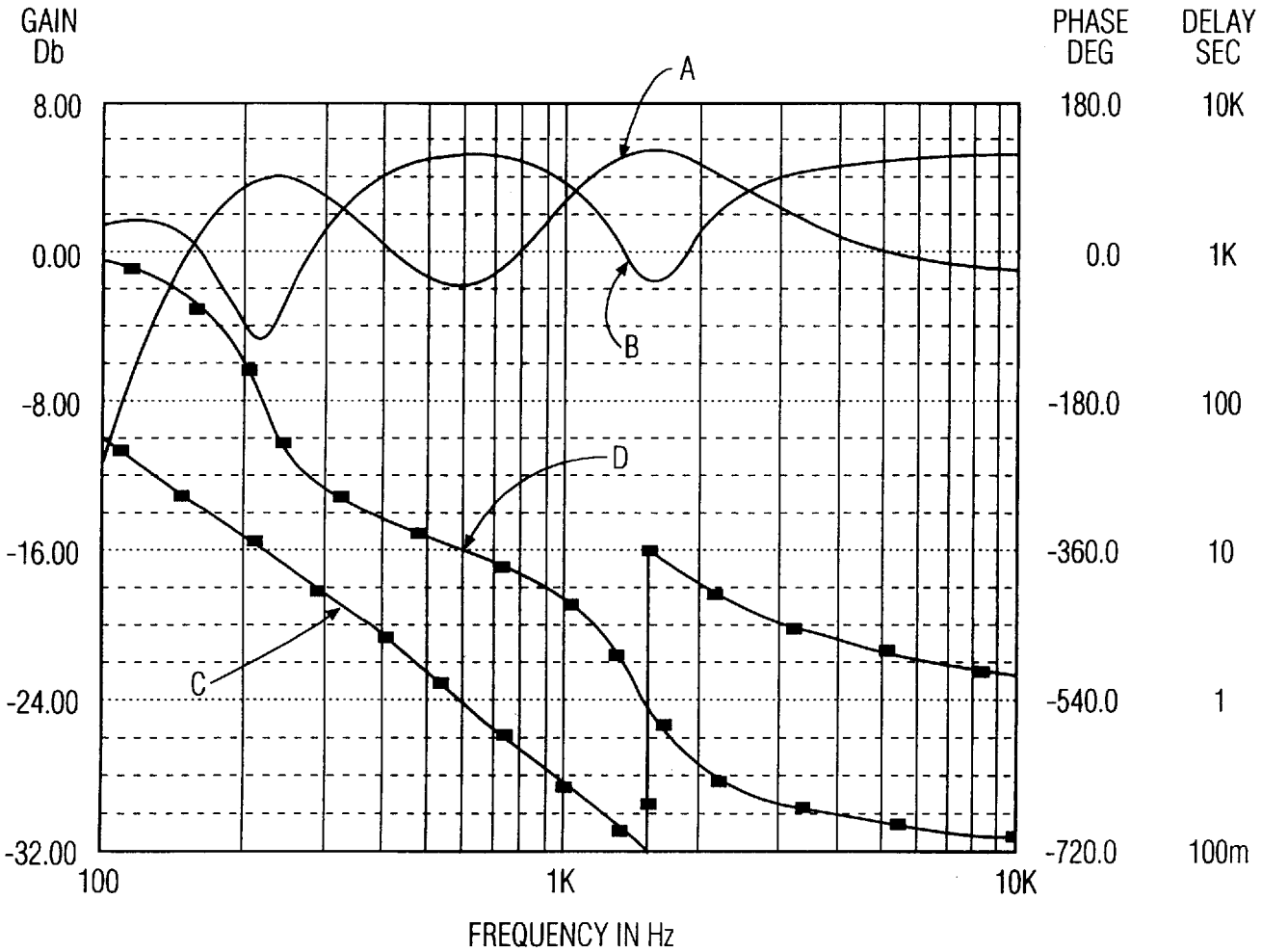
FIG. 3 shows a plot of the response curves of the left output signal and the left crosstalk signal for the circuit arrangement of FIG. 2.

The phase shifter arrangement 24 is formed by the series arrangement of two all pass phase shifters 30 and 32, each providing a gain of −6 dB. As such, the net gain for the (L+R) signal is 0 dB, while the net gain for the (L−R) signal is 8 dB, such that in certain areas of the audio frequency range, the differential between the desired left or right signal and the corresponding right or left cross-talk signal is 7–8 dB. This is shown in the plots A and B of FIG. 3, in which the responses of the $L_{OUT}$ signal and the $R_{OUT}$ cross-talk signal, respectively, are shown with respect to frequency. FIG. 3 further shows plots C and D of the phase of the LOUT signal and the ROUT crosstalk signal with respect to frequency.

Figure 4:
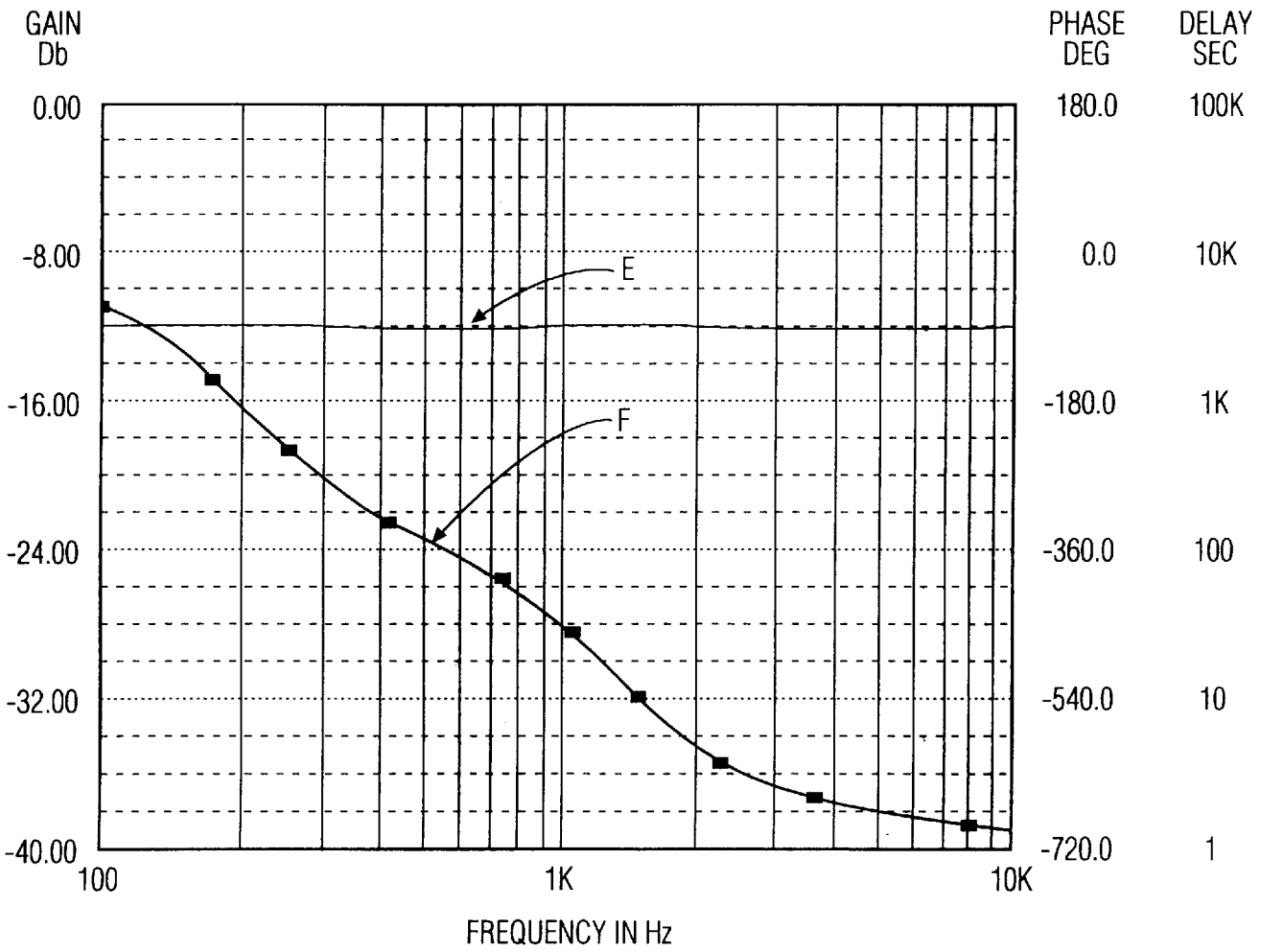
FIG. 4 shows a plot of the response curve of a phase shifter arrangement in the circuit arrangement of FIG. 2.

FIG. 4 shows a plot of the amplitude response/gain E (in dB) with respect to frequency, and the combined phase F (in degrees) with respect to frequency of the phase shifter arrangement 24. It should be noted that the amplitude response/gain produces a flat line at −12 dB, while the phase varies from approximately −60 degrees to −700 degrees.

Figure 5:
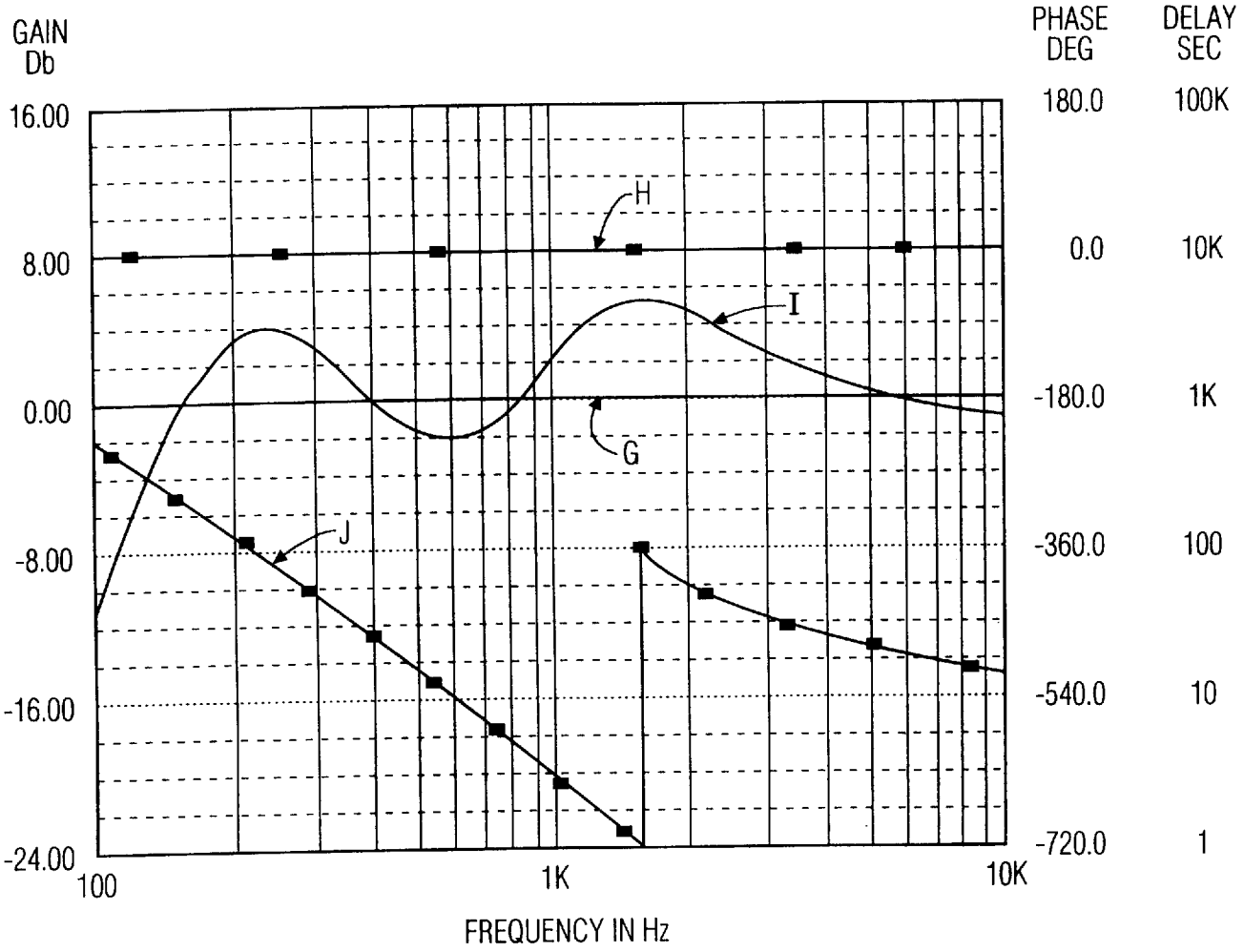
FIG. 5 shows a plot of response curves for the circuit arrangement of FIG. 2.

FIG. 5 shows a plot of the overall gain (in dB) and phase (in degrees) of the circuit arrangement. In FIG. 5, line G represents the (L+R) gain, line H represents the (L+R) phase response, line I represents the amplitude response of a single channel (L or R), and line J represents the phase response of a single channel (L or R).

Figure 6:
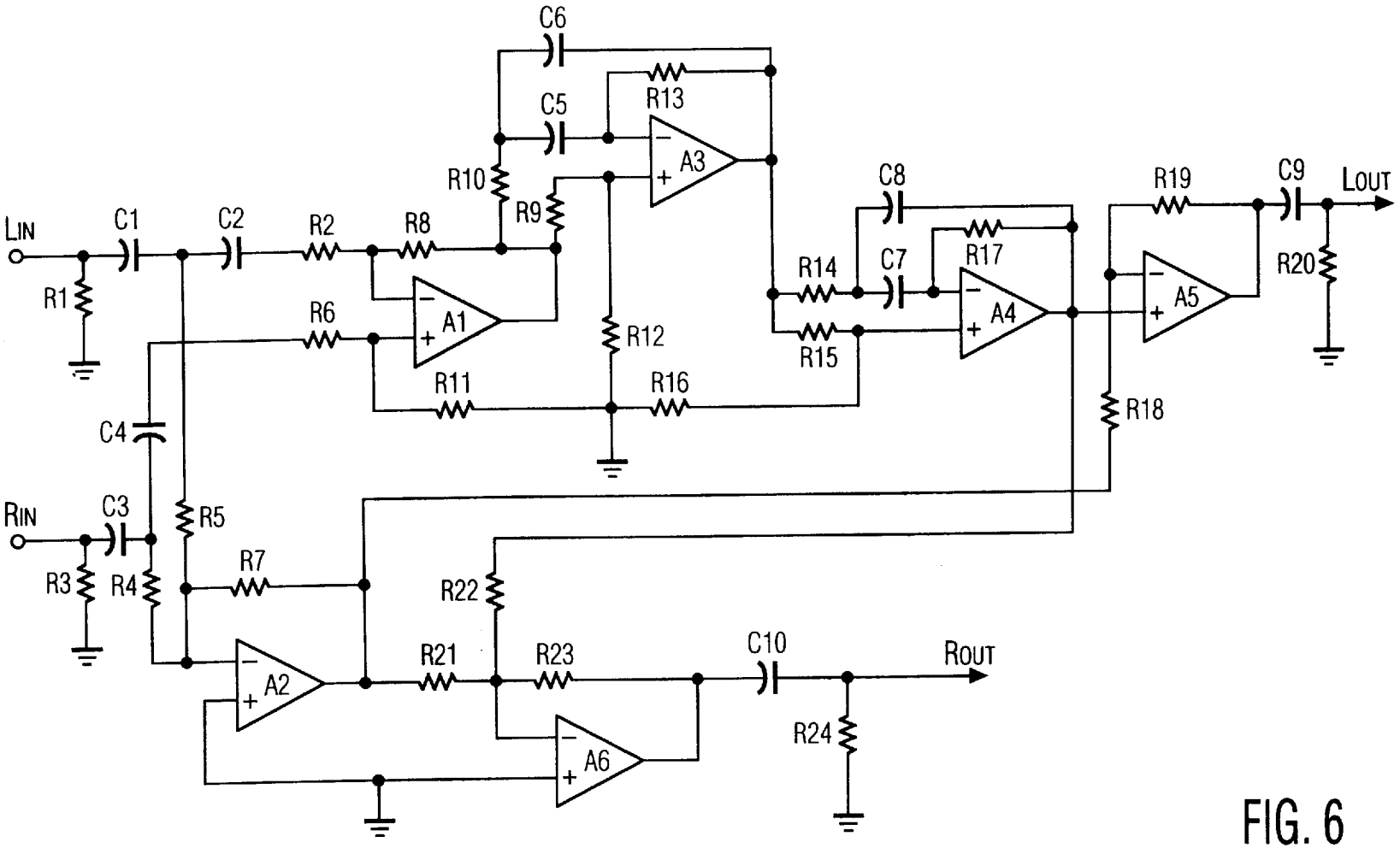
FIG. 6 is a schematic diagram of the circuit arrangement for the second embodiment of the invention of FIG. 2.

FIG. 6 is a schematic diagram of circuit arrangement for a practical embodiment of the invention. In particular, the left input LIN is connected to ground through a resistor R1 and, through the series arrangement of a first capacitor C1, a second capacitor C2 and a resistor R2 to the inverting input of a differential amplifier A1. Similarly, the right input RIN is connected to ground through a resistor R1 and, through the series arrangement of a capacitor C3 and a resistor R4, to the inverting input of summing amplifier A2. The junction between capacitors C1 and C2 is also connected to the inverting input of summing amplifier A2 through a resistor R5, while the junction between capacitor C3 and resistor R4 is connected to the non-inverting input of differential amplifier A1 through the series combination of capacitor C4 and resistor R6. The inverting input of summing amplifier A2 is connected to its output via a resistor R7. Arranged as such, differential amplifier A1 forms the matrix circuit 22 while summing amplifier A2 forms the matrix circuit 20.

The inverting input of differential amplifier A1 is connected to its output through a resistor R8 which is then connected, on the one hand, through a resistor R9, to the non-inverting input of differential amplifier A3, and on the other hand, through the series combination of a resistor R10 and a capacitor C5, to the inverting input of differential amplifier A3. The non-inverting input of differential amplifier A1 is also connected to ground through resistor R11, as is the non-inverting input of differential amplifier A3 connected to ground through resistor R12. The junction between resistor R10 and capacitor C5 is connected to the output of differential amplifier A3 via a capacitor C6, while the inverting input of differential amplifier A3 is connected to its output via a resistor R13.

The output of differential amplifier A3 is connected, on the one hand, through the series arrangement of a resistor R14 and a capacitor C7, to the inverting input of differential amplifier A4, and, on the other hand, through a resistor R15, to the non-inverting input of differential amplifier A4. The non-inverting input of differential amplifier A4 is connected to ground via resistor R16. The junction between resistor R14 and capacitor C7 is connected to the output of differential amplifier A4 via a capacitor C8, while the inverting input of differential amplifier A4 is connected to its output via a resistor R17. Differential amplifiers A3 and A4 thus form phase shifters 30 and 32 of the phase shifter arrangement 24.

The output of differential amplifier A4 is connected to the non-inverting input of differential amplifier A5, while the output of differential amplifier A2 is connected to the inverting input of differential amplifier A5 via a resistor R18. A resistor R19 connects the inverting input of differential amplifier A5 with its output which is, in turn, connected, through a series arrangement of a capacitor C9 and a resistor R20, to ground, the junction between the capacitor C9 and resistor R20 being connected to the left output LOUT. As such, differential amplifier A5 forms the matrix circuit 26.

The output of differential amplifier A2 is connected to the inverting input of differential amplifier A6 via a resistor R21, while the output of differential amplifier A4 is connected to this inverting input via a resistor R22. The non-inverting inputs of differential amplifiers A2 and A6 are connected to ground. A resistor R23 connects the non-inverting input of differential amplifier A6 to its output which is, in turn, connected, through the series combination of a capacitor C10 and a resistor R24, to ground, the junction between capacitor C10 and resistor R24 being connected to the right output $R_{OUT}$. As such, differential amplifier A6 forms the matrix circuit 28.

In an exemplary embodiment, the values of the above components are as follows:

| RESISTORS | |
|---|---|
| R1, R3, R20, R24 | 100 KΩ |
| R2, R6, R7, R18, R19, R22 | 10 KΩ |
| R4, R5, R21, R23 | 20 KΩ |

-continued

| | |
|---|---|
| R8, R11 | 27 KΩ |
| R9, R12, R15, R16 | 47 KΩ |
| R10, R14 | 8.2 KΩ |
| R13, R17 | 33 KΩ |
| CAPACITORS | |
| C1, C3, C9, C10 | 5 μF |
| C2, C4 | 0.1 μF |
| C5, C6 | 47 nF |
| C7, C8 | 6.8 nF |

The differential amplifiers A1–A6 are each type LF347.

Numerous alterations and modifications of the structure herein disclosed will present themselves to those skilled in the art. However, it is to be understood that the above described embodiment is for purposes of illustration only and not to be construed as a limitation of the invention. All such modifications which do not depart from the spirit of the invention are intended to be included within the scope of the appended claims.

What is claimed is:

1. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means, the second difference forming means forming a left channel output signal; and second summing means having a first input for receiving the sum signal and a second input coupled to the output of the phase shifting means, the second summing means forming a right channel output signal;

and wherein:

the first difference forming means include a capacitor and resister connected in series between the first arrangement input and one of the inverting or non-inverting amplifier inputs of a first differential amplifier and includes another capacitor and resister in series between the other arrangement input and the other input of the first differential amplifier; and the first combining means includes a respective series circuit of a capacitor and resister between each of the first and second inputs of the arrangement and the same input of a second differential amplifier.

2. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means. the second difference forming means forming a left channel output signal; and second summing means having a first input for receiving the sum signal and a second input coupled to the output of the phase shifting means, the second summing means forming a right channel output signal;

and wherein the first combining means has a gain of approximately 0 dB; the second combining means has a gain of approximately 0 dB for the signal from the first combining means, and a gain of approximately 6 dB for the signal from the phase shifting means; the first difference forming means has a gain of approximately 14 dB; the second difference forming means has a gain of approximately 0 dB for the signal from the first combining means, and a gain of approximately 6 dB for the signal from the phase shifting means; and the phase shifting means has a gain of approximately −12 dB.

3. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means, the second difference forming means forming a left channel output signal; and second summing means having a first input for receiving the sum signal and a second input coupled to the output of the phase shifting means, the second summing means forming a right channel output signal;

and wherein the phase shifting means comprises a series arrangement of two phase shifters, each of the phase shifters being all-pass (0°–360°) phase shifting networks.

4. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means, the second difference forming means forming a left channel output signal; and second summing means having a first input for receiving the sum signal and a second input coupled to the output of the phase shifting means, the second summing means forming a right channel output signal;

and wherein:

the second difference forming means include a capacitor in series between the output of a first differential amplifier and one of the output channels; and the second summing means include a resister between the output of the first summing means and one of the inputs of a first differential amplifier and another resister between the output of the phase shifting means and the same input of the second differential amplifier and a capacitor in series between the output of the second differential amplifier and the other of the output channels.

5. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means, the second difference forming means forming a left channel output signal; and second summing means having a first input for receiving the sum signal and a second input coupled to the output of the phase shifting means, the second summing means forming a right channel output signal;

and wherein each of the first and second difference forming means and the first and second summing means include a differential amplifier with a resistance connected between the output of the amplifier and the inverting input of the amplifier with a resistance selected so as to provide a predetermined gain of the amplifier.

6. The circuit arrangement of claim 5, wherein one or more resisters in one or more of the inputs of the differential amplifiers of the second difference forming means and the second summing means provide different gains for the different inputs of the second difference forming means and the second summing means.

7. A circuit arrangement, comprising:

a first input and a second input for receiving, respectively, a left channel signal and a right channel signal of in input stereo signal;

first combining means coupled to the first and second inputs for additively combining the left and right channel signals thereby forming a sum signal;

first difference forming means also coupled to the first and second inputs for forming a difference between the left and right channel signals, thereby forming a difference signal;

phase shifting means having an input for receiving the difference signal;

second difference forming means having a first input for receiving the sum signal and a second input coupled to an output of the phase shifting means, the second difference forming means forming a left channel output signal; and second summing means having a first input for receiving the sum signal and a second input coupled to the output of the phase shifting means, the second summing means forming a right channel output signal;

and wherein the phase shifting means includes a series arrangement of two phase shifters, each of the phase shifters being an all-pass (0°–360°) phase shifting network having an average gain of approximately −6 dB.

8. The circuit arrangement of claim 7, wherein each of the two phase shifters include:

a differential amplifier;

a series circuit of a capacitor and resister between the phase shifter input and the inverting input of the differential amplifier;

a resister between the phase shifter input and the non-inverting input of the differential amplifier; and a parallel circuit of a capacitor and resister between the output of the differential amplifier and the inverting input of the differential amplifier.

* * * * *